US005947673A

United States Patent [19]

Strube

[11] Patent Number: 5,947,673

[45] Date of Patent: Sep. 7, 1999

[54] STEPPED SEAM FOR A CAN

[75] Inventor: Lutz Strube, Cremlingen, Germany

[73] Assignee: Schmalbach-Lubeca AG, Germany

[21] Appl. No.: 08/836,373

[22] PCT Filed: Nov. 14, 1995

[86] PCT No.: PCT/DE95/01574

§ 371 Date: May 13, 1997

§ 102(e) Date: May 13, 1997

[87] PCT Pub. No.: WO96/15036

PCT Pub. Date: May 23, 1996

[30] Foreign Application Priority Data

Nov. 14, 1994 [DE] Germany ..... 44 40 628
Nov. 13, 1995 [WO] WIPO ..... PCT/DE95/01566

[51] Int. Cl.[6] ..... B21D 51/32; B65D 6/30

[52] U.S. Cl. ..... 413/4; 413/6; 413/7; 53/488

[58] Field of Search ..... 413/4, 6, 7, 34, 413/31, 26; 53/488, 486, 296, 289, 290, 325, 324, 366

[56] References Cited

U.S. PATENT DOCUMENTS

| | | | |
|---|---|---|---|
| 2,327,424 | 8/1943 | Henchert | 113/121 |
| 3,688,464 | 9/1972 | Fox | 53/488 X |
| 4,037,550 | 7/1977 | Zofko | 113/120 |
| 4,626,157 | 12/1986 | Franek et al. | 413/4 X |
| 4,626,158 | 12/1986 | Le Bret | 413/6 |
| 5,054,265 | 10/1991 | Perigo et al. | 53/488 |

FOREIGN PATENT DOCUMENTS

| | | |
|---|---|---|
| 11925 | 1/1903 | Austria . |
| 0021298 | 6/1980 | European Pat. Off. . |
| 0065842 | 5/1982 | European Pat. Off. . |
| 0445721 | 3/1991 | European Pat. Off. . |
| 334017 | 7/1903 | France . |
| 2327149 | 12/1973 | France . |
| 158518 | 12/1902 | German Dem. Rep. . |
| 2134034 | 7/1971 | Germany . |
| 1752316 | 2/1972 | Germany . |
| 2924812 | 6/1972 | Germany . |
| 2352929 | 10/1973 | Germany . |
| 2241631 | 9/1990 | Japan . |
| 15570 | of 1903 | United Kingdom . |
| 2097748 | 12/1981 | United Kingdom . |

OTHER PUBLICATIONS

1936, W. Friebel Handbuchder, Dosenfertigung, pp. 82 & 83.

PCT International Preliminary Examination Report.

1953, P.Aurich, Verbinden von Blech Durch Falzen—II. Teil, pp. 507–511.

1958, Von Edmund G. Blake, Verschliefmaschinen–Einsstellungen, pp. 45–54.

*Primary Examiner*—James F. Coan

*Attorney, Agent, or Firm*—Duane, Morris & Heckscher LLP

[57] ABSTRACT

An improvement in the shape of a fold in a tin can allows the use of sheet metal of lower gauge than that currently used. This is achieved with a fold geometry on a tin can which is closed off with a double fold, such as for a drink or food tin; by providing a continuous or stepped contour on the fold side; and by insuring that the lid hook is clearly in area-contact (positive fit) on its outer side with the free end of the body hook in its lower third. The invention may be applied to standard-gauge as well as thinner-gauge sheet metal, and generally results in a better seal.

14 Claims, 2 Drawing Sheets

STEPPED SEAM FOR A CAN

The technical field of the invention is the providing of a seam on a can body closed with a (can) end, such as beverage or food can made from sheet material. The function of such a seam is to hold the can end and the can body tightly together to protect them also against relatively high forces possibly becoming effective from outside, e.g. by pressure or shock, and from inside, e.g. by high or low pressure, and moreover, to hermetically air-seal the content of the can.

Whereas the seam was soldered for sealing purposes in former times, it has been usual a long time now to introduce a sealing compound into the seam and to close the seam without soldering (compare FIG. 1 of DE-A 21 34 034; FIG. 3 of EP-A 445 721; FIG. 2 of FR-A 2 327 149; FIG. 12 of U.S. Pat. No. 4,626,158; FIG. 6 of U.S. Pat. No. 2,327,424).

An object of the invention is to improve the characteristics of such a seam with regard to its mechanical stability as well as with regard to a realiable and durable hermetical sealing; consequently, the stability of the seam shall be improved, particularly when using metal sheets having a reduced thickness compared to presently used sheets with a thickness of about 0.24 mm.

According to claims 1, 9 or 12 this object is solved by appropriately designing the seam geometry with the seam geometry being improved according to the present invention, thinner metal sheets may be used for the production of at least one of the can body or the can end, providing equal stability and tightness, or—when using metal sheets of usual thickness—a substantially higher stability and a hermetical sealing of even higher reliability may be obtained. Said high stability is achieved by a stronger clamping or squeezing and (inter)locking of the seam elements in a limited portion of the seam height. Thus, the seam receives a higher stability which also permits the use of metal sheets of reduced thickness (claim 8).

The hermetical sealing is also improved by said increased clamping or squeezing.

The additional clamping or squeezing and (inter)locking being effected only in the lower portion of the seam, the compound material is prevented from moving away from the upper seam portion when the seam is shaped. With the new seam geometry a direct contact of metal sheets in the upper end portion of the seam is avoided, so that the compressed sealing compound performs its hermetical sealing function better than in case of a direct metal-to-metal contact (claim 5).

In a preferred embodiment,—in a readily shaped seam—the lower and outer portion of the can end hook is in firm, particularly in surface contact (positive fit) with the surface portion located above the free end of the body hook, whereas the upper portion of the can end hook being close to the edge of the seam is markedly offset in radially outward direction with respect to said lower portion, thus being spaced apart from the adjacent metal sheet portion of the body hook (claim 6). Thus, a contoured outer seam surface is provided, said two mentioned upper and lower portions being interconnected continuously or by a preferably smooth step (claim 2).

Consequently, the firm pressure adhesion, preferably the pressure contact (positive fit) of the metal sheet portions only extends along the lower seam portion (claim 6). Said lower seam portion has substantially cylindrical extension (claim 7). It decouples the width b of the seam from the length tolerance of the body hook.

The seam geometry can at any time be examined and determined by a making a cut through the seam of a closed can.

In addition to the improvement of the seam, the invention permits the use of thinner metal sheets than usual today. The application of surface pressure contact to the portions of the metal sheets in the lower half to the lower third of the seam may reach so far that a mechanical locking is provided at the lower edge of the body hook. The entire seam is of markedly higher stability, namely for both the use of usual metal sheets and the use of metal sheets with reduced thickness.

The surface pressure contact in the lower seam portion (claim 6, claim 7) may result in a locking step on the free edge of the beaded body hook, which step may take over holding and locking function in direction of the can axis.

The seaming or shaping roller providing or applying said seam contour has two groove portions having two different diameters with respect to the roller axis (claim 12, claim 13). Said two groove portions are axially offset with respect to each other to constitute a transient portion.

The transient portion (or generally: the annular projection) leads into a substantially cylindrical shape (claim 14) to give the same cylindrical shape to the lower portion when shaping the seam (claim 6, claim 7). In the engaged position, the substantially cylindrical portion of the seaming roller (VR1) extends in parallel direction with respect to the outer surface of the seaming chuck VK.

Therewith, not only a better stability when using thinner metal sheets, but also a decoupling of the width b of the readily shaped seam from the length tolerance of the body hook are surprisingly obtained. The width b of the seam is only dependent on the thickness of the metal sheets used, the compound also looses its undesirable influence on said width b of the seam.

The invention is described in detail with schematic drawings on the basis of an embodiment.

Figure 2:
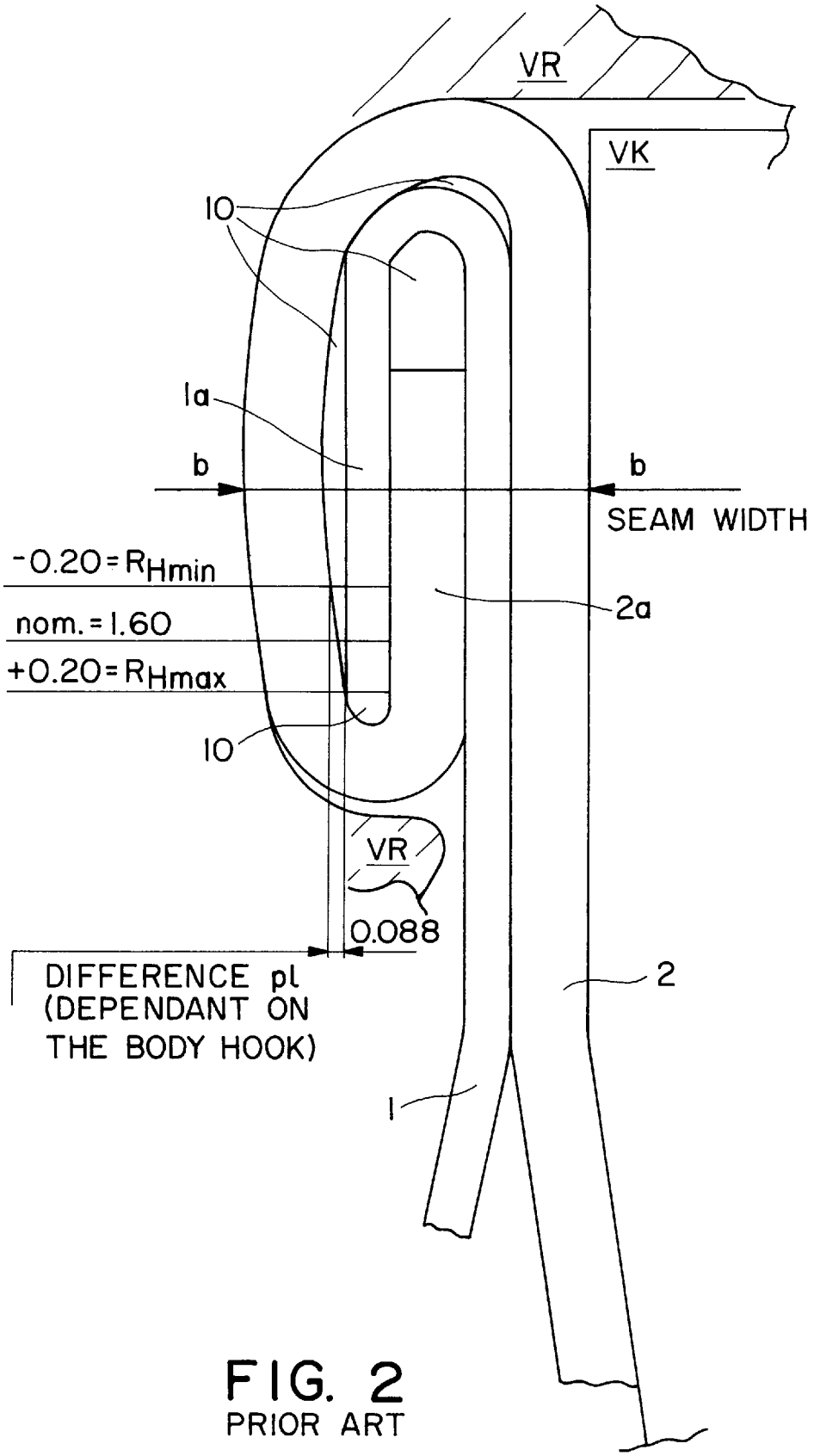
FIG. 2 PRIOR ART
FIG. 2 illustrates a seam geometry according to prior art.

In addition to the seam geometry, both Figures also show the geometry of the seaming chuck VK and (traced) also the geometry of the seaming rollers VR and VR1 as counter-contour with respect to the outer contour of the seam, respectively. The outer contour of the (inside situated) seaming chuck VK, such as illustrated by FIG. 2, may be used without modification for obtaining the seam geometry according to the invention, so that all inside metal sheet layers 2, 1, 2*a*, 1*a* with the exception of the upper portion 2*b* of the outside layer 2*b*, 2*c* of the can end hook are in surface contact and have essentially cylindrical or weakly conical extension with regard to the axis of the can.

Figure 1:
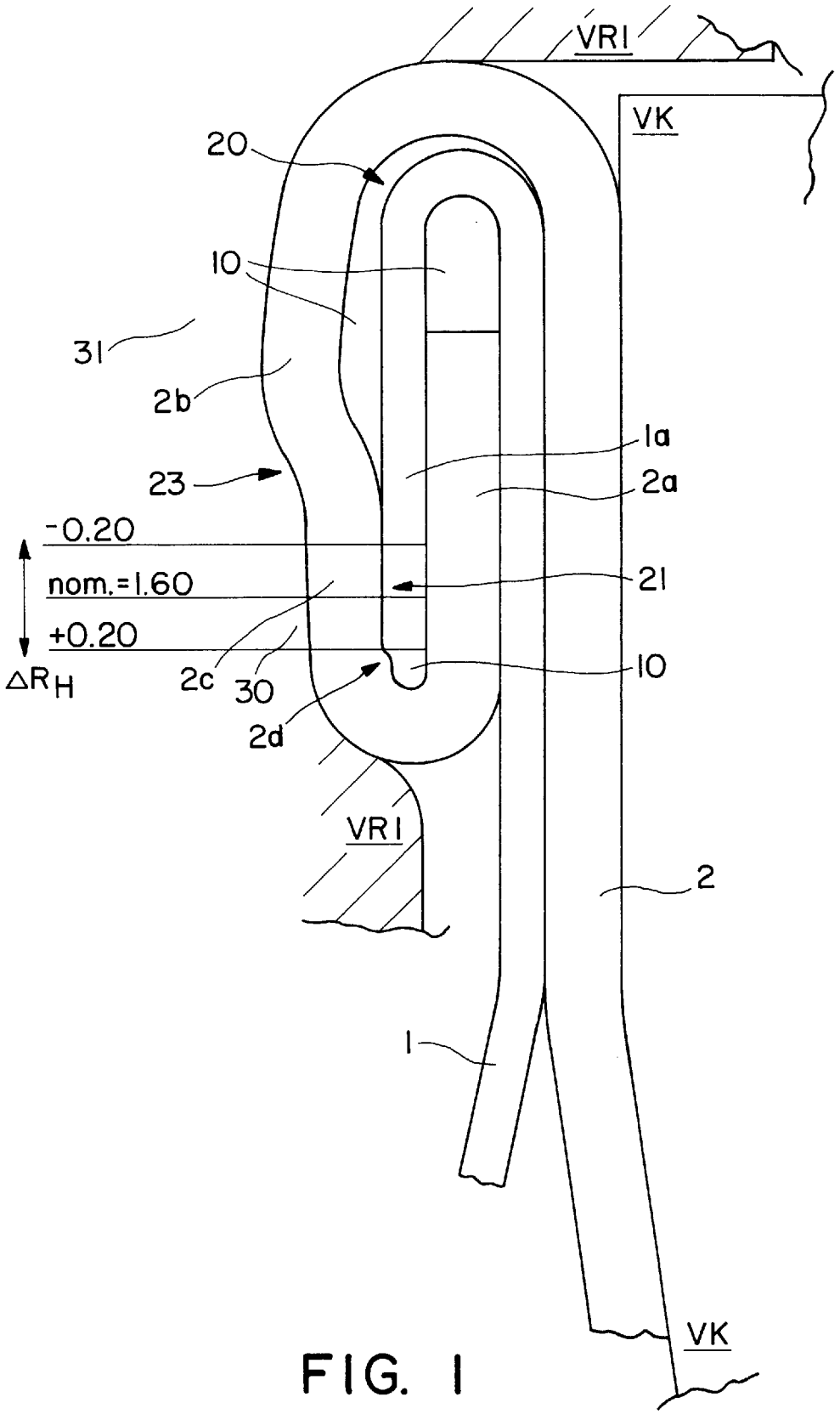
FIG. 1 is a sectional view of a double seam according to the embodiment of the invention.

FIG. 1 illustrates an embodiment of a double seam according to the invention. Reference numeral 1 designates the wall of the can, reference numeral 2 designates the can end with its (countersink) central wall.

By providing the profile 30, 31 of the traced seaming roller VR1 as a stepped contour 23, the influence of the length tolerance of the body hook $\Delta R_H$ (delta $R_H$) on the width b of the seam is neutralized. Additionally, a better squeezing of the can end hook as well as a mechanical locking at position 2*d* in its lower portion 2*c* by a displacement of can end material are obtained. Thereby, tightness of the seam is guaranteed even in case of changing pressure inside the can.

The sharper-shaped lower portion 2*c* of the seam leads to a higher stability of the seam, such that particularly when using thinner can end and body sheets, the rolling up of the readily shaped seam is impeded by the pressure inside the can, thus permitting the use of metal sheets which are thinner than usual today.

FIG. 2 shows a seam geometry according to prior art. With the geometries of the seaming chuck VK and the seaming roller VR (2nd operation) used according to this embodiment, the achievable seam width b is essentially influenced by a change (tolerance in the range of $R_{Hmin}<R_{Hnom}<R_{Hmax}$) of the length $R_H$ of the body hook 1*a*. The seam width b being essential for the evaluation of the seam quality as well as being used for the basic adjustment of a seaming machine, definition problems occur in FIG. 2, which problems make it impossible to observe the current seam width tolerance $\Delta b=\pm 0.05$ mm (delta b).

Moreover, in FIG. 2, the can end hook is insufficiently squeezed, which may result in a leakage of the filled can, particularly when using thinner metal sheets.

FIG. 1 illustrates a closed seam of a can (upper edge portion in cross-sectional view) having a contour according to the embodiment of the invention. The can end hook 2*a* is in engagement with the body hook 1*a*. In the overlapping portion, both hooks are in sealing contact. In the remaining portion, a sealing compound 10 is provided.

To reduce the variability Δb (delta b) of the seam thickness or seam width b, the seam—the seam geometry—is provided with a stepped contour 23 in its lower portion 2*c*. In the embodiment, it is the lower third. The stepped contour 23 stabilizes the seam. If the flanging pressure in radially inward direction is high enough, the end portion 21 of the body hook 1*a* obtains an additional locking 2*d* which provides a stronger sealing, but simultaneously also takes over holding and compensating function.

The difference d in size also shown in FIG. 2 (as dependent on the length $R_H$ of the body hook), is replaced according to FIG. 1 by pressing a lower portion 2*c* of the outer can end portion 2*b*, 2*c* in surface contact with the lower edge portion 21 of the body hook 1*a*. The indicated tolerance of $\Delta R_H$ (delta $R_H$) does no longer produce a difference in size d (also compare FIG. 2); if d=0, the influence of $\Delta R_H$ (delta $R_H$) on b (the seam width) is also zero.

The vertical extension (height) of the surface pressure contact should be equal to or larger than the expected length tolerance $\Delta R_H$ (delta $R_H$), in the embodiment, it is about 1.5 times as large. In the embodiment, the height of the seam is three times larger than the surface contact portion 2*c*, the height of which is 1.5 * $\Delta R_H$. The mentioned stepped contour 23 at portion 2*c* may be selected to be smooth to more abrupt.

The closing apparatus comprises the seaming roller VR1, realizing the stepped contour 23 in direction of the (cylindrical) lower seam portion 30 (opposite 2*c*) with its grooved contour 30, 31. The stepped contour 23 may be applied directly during seaming (shaping the seam); it may as well be applied at the outer contour of the seam in a separate processing step after beading or shaping the seam.

The corresponding process (single-stage or double-stage) is carried out in a seaming machine comprising a seaming roller VR1 and a seaming chuck VK. Existing seaming machines may easily be converted.

The center plane of the seam is the plane extending in perpendicular direction with respect to the can axis and being located substantially in the middle of the seam height extending in direction of the can axis. Said plane is illustrated in FIG. 2 in a sectional view at line b of the seam width.

I claim:

1. In a metallic can closed with a double seam formed from an end hook and a body hook, said double seam having a height and a width and comprising first and second spaced-apart portions wherein said double seam has a seam geometry comprising:

a stepped contour on an outer face of said double seam, wherein the body hook has a free end-portion and an outer side and the end hook has a portion extending in a generally downward direction and shaped to provide a surface contact and a positive fit with the outer side of the free end-portion of the body hook for enhancing metal-to-metal contact in said first of said two spaced-apart portions, and a sealing portion disposed between opposing and spaced-apart metal surfaces of the seam and located, relative to said end hook, at a radially outward, axially upward end portion of the seam, the sealing portion comprising a compound for reducing metal-to-metal contact and so as to provide said second spaced-apart portion;

whereby the width of the seam is decoupled from (i) tolerances associated with a length dimension of said body hook, and (ii) an amount of sealant contained in said sealing portion.

2. The can with seam geometry according to claim 1, wherein the contour has a smoothly stepped shape.

3. The can with seam geometry according to claim 1, wherein the contour has an abruptly stepped shape.

4. The can with seam geometry according to claim 1, further comprising upper and lower portions of the double seam, the upper portion markedly projecting in a radially outward direction with respect to the lower portion of the seam.

5. The can with seam geometry according to claim 1, wherein the seam geometry is markedly asymmetrical with respect to a center plane of the seam, particularly by about one and a half times the thickness of the metal sheet.

6. The can with seam geometry according to claim 1, wherein at the sealing portion, substantially more compound is provided above a center plane of the seam than below said plane.

7. The can with seam geometry according to claim 4, wherein the end hook includes upper and lower portions wherein the lower portion of the seam is markedly narrower than the upper portion above said lower portion, and only the lower portion of the end hook is in surface contact with the free end-portion of the body hook, and the outer face of said lower seam portion extends substantially parallel with respect to an inner surface of the can that is located opposite to said free end-portion.

8. The can with seam geometry according to claim 1, further comprising a can body wherein the end hook comprises an inside portion and an outer-layer portion, the outer-layer portion being located below a first seam portion, the outer-layer portion and the body hook extending substantially parallel and being in surface contact with each other.

9. The can with seam geometry according to claim 1, wherein the seam is formed of sheet material having a thickness of ≦0.23 mm, and particularly 0.22 mm.

10. The seam geometry according to claim 1 wherein a vertical extension of said portion having surface contact and positive fit having a length dimension at least equal to the absolute value of said length tolerances of said body hook wherein said length tolerances are the maximum length tolerances for said body hook.

11. A process for at least one of shaping, providing, or contouring of, a seam geometry of a double seam seal formed from an end hook and a body hook, comprising the steps of:

providing the end hook with an upper and lower portion;

forming a stepped contour in an outer surface of the end hook;

sealing the lower portion by contact between opposing metal sheets, whereby said sealing is stronger than that of the upper portion, the upper portion containing a sealant between spaced-apart inner surfaces of the body and end hook.

12. The process according to claim 11, wherein the step of forming the stepped contour further comprises the step of forming a seam which is asymmetrical with respect to a center plane thereof.

13. A seaming roller for combination with a seaming chuck having an outer surface in a seaming machine for applying a double seam seal to metal cans and can ends, the double seam seal formed from an end hook and a body hook, the seam roller comprising:

an axis of rotation;

a groove extending circumferentially around said axis of rotation;

an annular projection extending substantially orthogonal with respect to said axis of rotation, and substantially parallel with respect to the axis of rotation and the surface of the seaming chuck.

14. The seaming roller according to claim 13, further comprising an inside shaping face with three portions: a stepped transient portion between first and second portions, the first portion comprising the groove and being of smaller diameter than that of the stepped transient portion, the second portion being of markedly larger diameter than that of the first portion, as measured from a roller axis to said projection or the bottom of the groove.

* * * * *